United States Patent [19]

Radke

[11] 4,304,319

[45] Dec. 8, 1981

[54] AUTOMATIC ELEVATOR CONTROL SYSTEM

[75] Inventor: Wilmer G. Radke, Bremerton, Wash.

[73] Assignee: The United States of America as represented by the Secretary of the Navy, Washington, D.C.

[21] Appl. No.: 89,659

[22] Filed: Oct. 30, 1979

[51] Int. Cl.[3] ..... B66B 1/40

[52] U.S. Cl. ..... 187/29 R

[58] Field of Search ..... 187/29

[56] References Cited

U.S. PATENT DOCUMENTS

| | | | |
|---|---|---|---|
| 2,666,110 | 1/1954 | Berkovitz | 187/29 |
| 3,138,223 | 6/1964 | Keiper et al. | 187/29 |
| 3,815,711 | 6/1974 | Hoelscher | 187/29 |
| 3,983,961 | 10/1976 | Aron | 187/29 |

*Primary Examiner*—J. V. Truhe
*Assistant Examiner*—W. E. Duncanson, Jr.
*Attorney, Agent, or Firm*—R. S. Sciascia; Charles D. B. Curry

[57] ABSTRACT

An automatic elevator control system including high and low speed, up and down, braking, emergency stop, door interlock, slack cable, overtravel, motor overload, select floor and run/stop operations. The system employs an electrically passive elevator wherein position sensing is achieved at each deck by a pair of proximity switches. The control system logic uses these proximity switches to denote low speed/elevator high, stop-/elevator at deck and low speed/elevator low condition. The system automatically takes into account elevator overshoot and well as interim high speed operations. The system design criteria and logic are established to allow for use of self testing proximity switches and miniature high speed relays that may be visually monitored and easily tested. These relays are used for low current logic functions and not for power transfer functions.

2 Claims, 9 Drawing Figures

AUTOMATIC ELEVATOR CONTROL SYSTEM

BACKGROUND OF THE INVENTION

1. Field of the Invention

The present invention relates to control systems and more particularly to an automatic elevator control system.

2. Description of Prior Art

Shipboard elevator control systems have used large relays coupled with generally unreliable mechanical limit switches and, more recently, proximity switches with solid state logic controllers. These systems were difficult to troubleshoot and repair parts were expensive and difficult to obtain. In addition, there is a need for additional safety and automatic control features not presently available.

These problems have been overcome by the present invention by providing a control system that is safe, reliable and automatic. It is also relatively inexpensive and easy to troubleshoot.

SUMMARY OF THE INVENTION

Briefly, the present invention comprises an automatic elevator control system including high and low speed, up and down, braking, emergency stop, door interlock, slack cable, overtravel, motor overload, select floor and run/stop operations. The system employs an electrically passive elevator wherein position sensing is achieved at each deck by a pair of proximity switches. The control system logic uses these proximity switches to denote low speed/elevator high, stop/elevator at deck and low speed/elevator low conditions. The system automatically takes into account elevator overshoot as well as interim high speed operations. The system design criteria and logic are established to allow for use of self testing proximity switches and miniature high speed relays that may be visually monitored and easily tested. These relays are used for low current logic functions and not for power transfer functions.

STATEMENT OF THE OBJECTS OF THE INVENTION

An object of the present invention is to provide an effective automatic elevator control system.

Another object of the present invention is to provide an automatic elevator control system that is effective for shipboard operations.

Still another object of the present invention is to provide an automatic elevator control system that is relatively inexpensive and easy to troubleshoot.

A further object of the present invention is to provide an automatic elevator control system that employs proximity switches and miniature high speed relays as part of its logic.

DESCRIPTION OF THE PREFERRED EMBODIMENT

Figures 1, 1A, 1B, 1C:
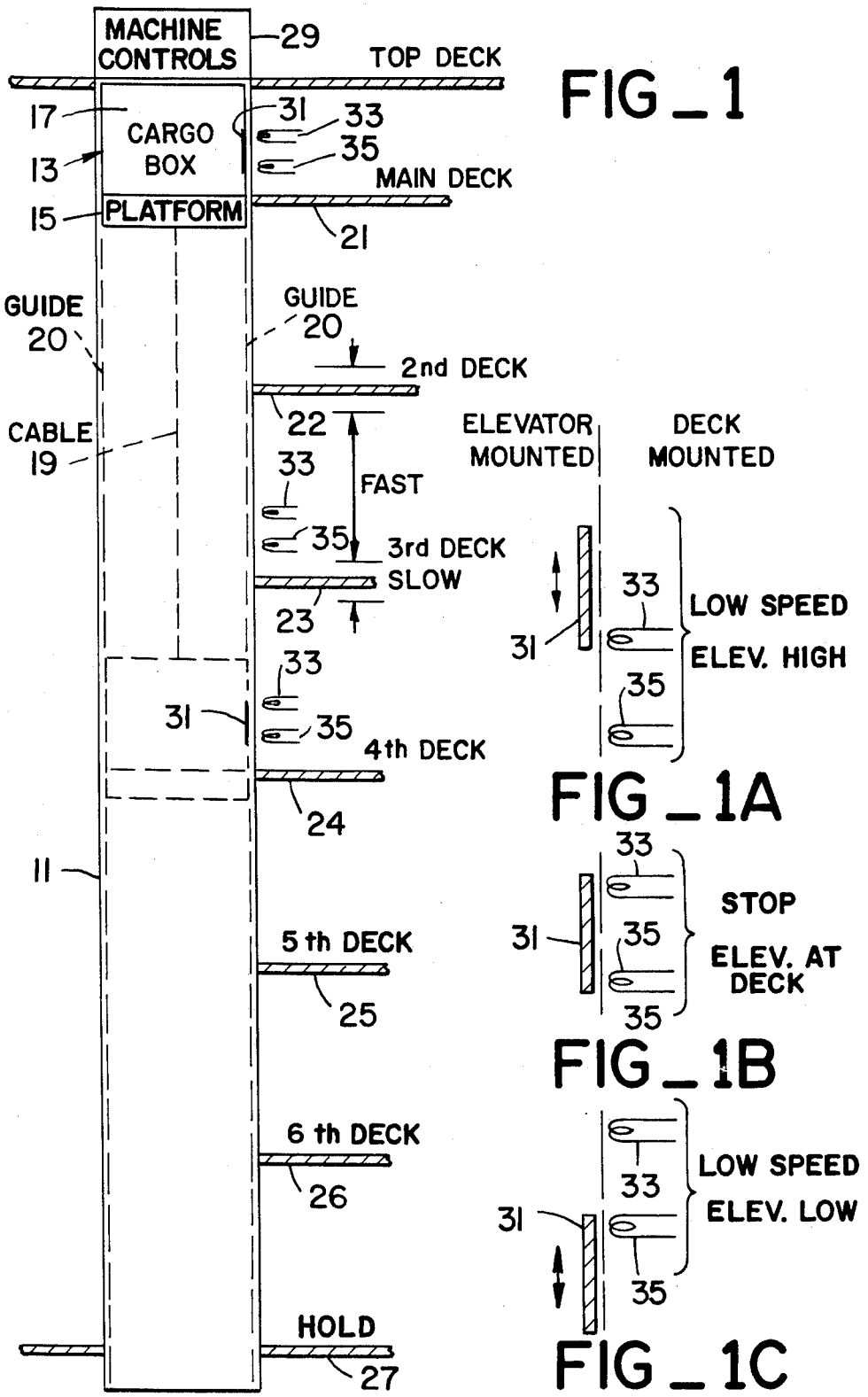
FIG. 1 is a diagramatic side elevation of an elevator system with which the control system of the present invention is used.
FIGS. 1A, 1B and 1C are diagrams showing the relative position of the proximity bar and the two proximity coils as used in the control system of the present invention.

In FIG. 1 is illustrated an elevator system with which the elevator controller of the present invention is used. The elevator system includes the elevator shaft 11, the elevator 13 including the platform 15 and cargo space 17. The elevator is raised and lowered by means of a cable 19 on guides 20 to service the various decks comprising main deck 21, second deck 22, third deck 23, fourth deck 24, fifth deck 25, sixth deck 26 and hold 27. The cable is driven and controlled by the machine unit 29. The elevator also includes a proximity bar 31 that magnetically interacts with proximity coils 33 and 35 that are located at each deck. In FIGS. 1A, 1B and 1C are shown the three conditions and corresponding locations of the proximity bar and coils. As shown in FIG. 1A when the bar 31 is adjacent coil 33, whether moving up or down, it is in the low speed/elevator high condition. It should be noted that if the bar is not interacting with either of the coils at a particular floor then it is at some other location and may be stopped, moving fast or moving slow. The position of the bar and coils are selected at each deck so the elevator moves slow when it is close to each side of the deck and fast at other times. Moreover, elevator high means the elevator is high with respect to a particular proximity coil whether moving up or down. In FIG. 1B the bar 31 is shown adjacent both coils 33 and 35. This is the stop/elevator at floor condition. In FIG. 1C the bar 31 is shown adjacent coil 35. This is the low speed/elevator low condition.

Figure 2A:
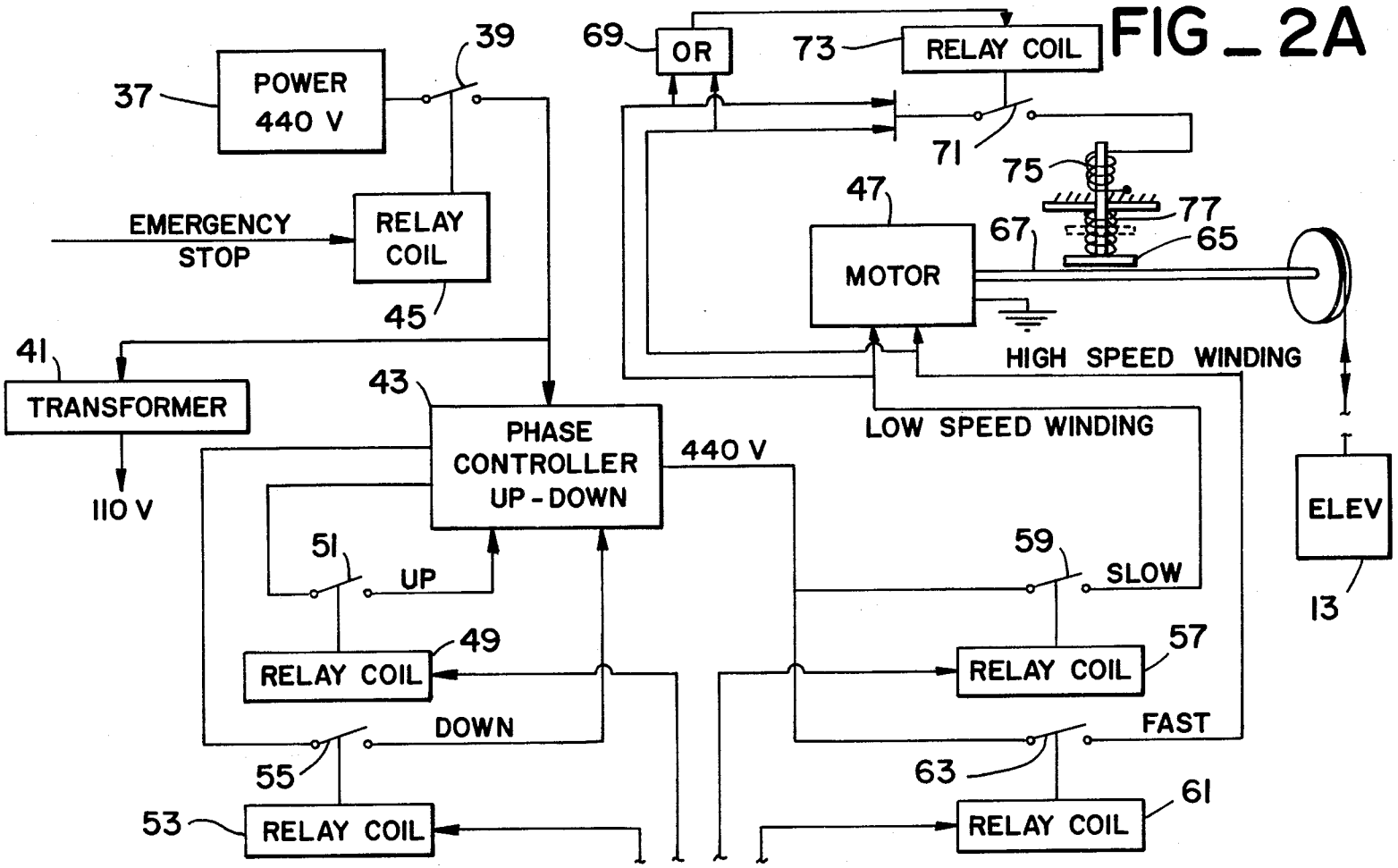
FIGS. 2A and 2B are a schematic diagram showing the overall features of the control system of the present invention.
Figure 2B:
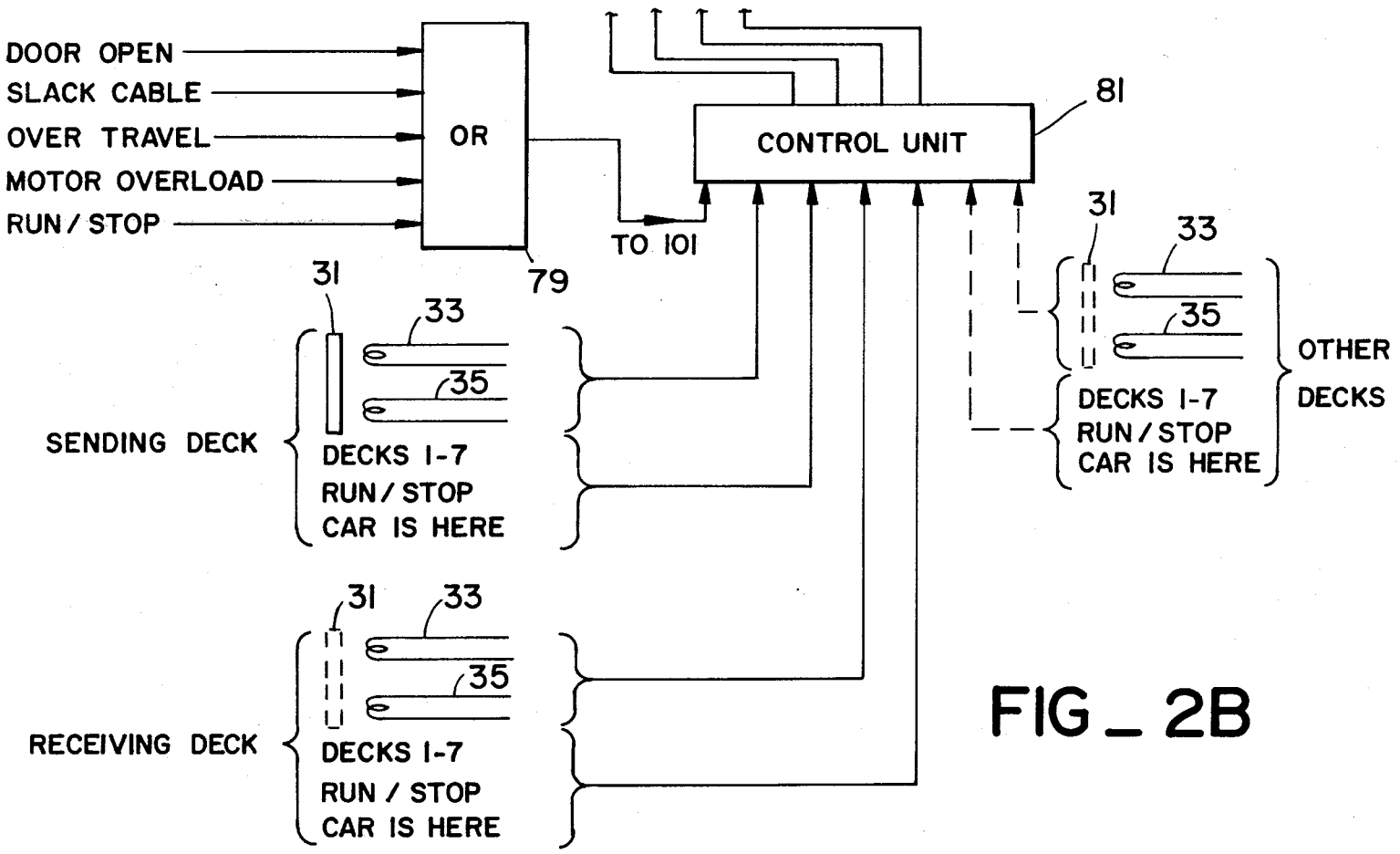

In FIGS. 2A and 2B are illustrated the overall electrical elevator control system of the present invention. This system includes a 440 volt power supply 37 that is connected through switch 39 to the inputs of transformer 41 and phase controller 43. The emergency stop signal is connected to relay coil 45. Upon the occurrence of the emergency stop signal switch 39 will open and no power will be applied to the system. The phase controller determines whether the 440 volt signal to the motor 47 will be in phase (clockwise/up) or 180° out of phase (counterclockwise/down). Relay coil 49 and its associated switch 51 control the "up" direction and relay coil 53 and its associated switch 55 control the "down" direction. Motor 47 includes low speed ent 65 is applied against motor shaft 67 when no power is applied to motor 47. This is achieved by connecting the two motor inputs through OR gate 69 and to switch 71. The output of OR gate 69 is connected to relay coil 73 for opening switch 71 when no power is applied to the motor. When switch 71 is open no power is applied to coil 75 and spring 77 biases brake element 65 against motor shaft 67 to stop elevator 13. When power is applied to the motor then power is applied to coil 75 and the brake element is removed from shaft 67.

Figure 3A:
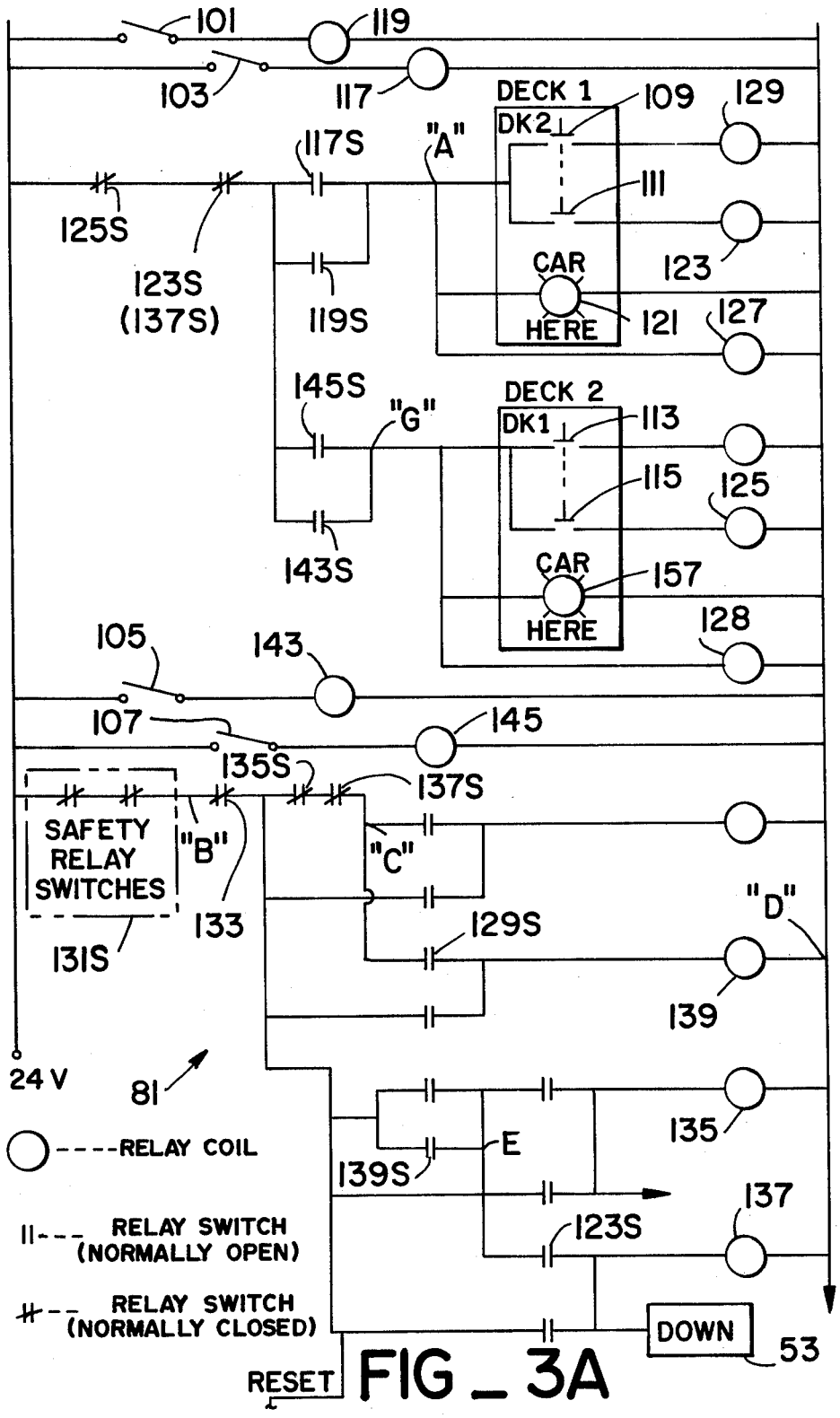
FIGS. 3A and 3B show the detailed logic of the control system of the present invention used for elevator control between two decks.
Figure 3B:
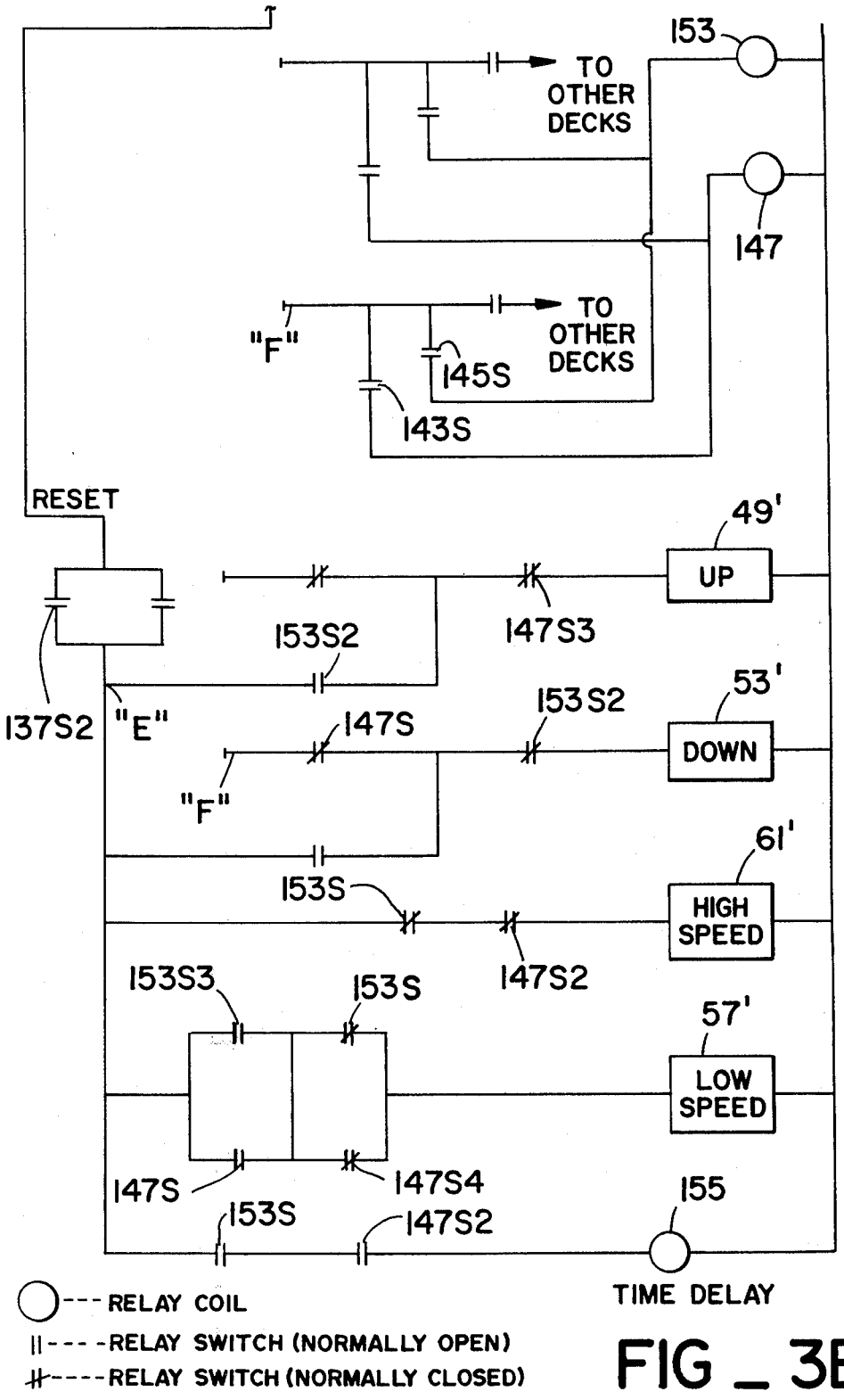

A plurality of safety parameters signal lines are applied to the input of OR gate 79. These include signals indicating door open, slack cable, overtravel, motor overload and run/stop. If there is no power to any one of these then all four of relay switches 51, 55, 59 and 63 are opened by control unit 81 the details of which are shown in FIGS. 3A and 3B. Control unit 81 also receives signals from the proximity coils 33, 35 at all decks. In addition, the control unit receives input signals from the floor dispatch switches (floors 1–7, for example) and run/stop switch from each deck as generally illustrated in FIG. 2B.

In FIGS. 3A and 3B are illustrated the details of the control unit 81 of FIG. 2B. Before considering the details of FIGS. 3A and 3B the following control requirements are presented for better understanding. This elevator system is intended for shipboard use wherein no power or active controls are on the elevator and the elevator is used to transport only cargo and not personnel. At each floor there are a group of six "send to deck" switches, one run/stop switch and a "car is here" indicator light. The sequence of operations for the elevator operator at a particular deck are as follows:

1. "Car Here" indicator light is "on"
2. Actuate "stop" of the run/stop switch (this opens the run/stop switch, prevents the elevator from running, and unlocks the elevator door)
3. Open the elevator door manually
4. Load the elevator
5. Close the elevator door manually (cannot operate unless closed)
6. Actuate "run" of the run/stop switch (this closes the run/stop switch and locks the elevator door)
7. Actuate selected "send to floor" switch Upon completion of these steps the elevator operator no longer has any control over the elevator, nor does any other elevator operator. The elevator will automatically go to the selected floor, turn on the "car here" indicator light and wait. The operator at the receiving floor can either go through the above sequence or immediately dispatch the elevator to another floor. This is achieved by actuating the "run" switch and the selected "send to floor" switch. There are many controls such as "up", "down", "high speed", "low speed", "safety" and "override" that are automatically performed by the system as hereinafter described.

In FIGS. 3A and 3B are illustrated a schematic diagram of the control unit 81 for operation of the elevator between two decks. Deck 1 and deck 2 were selected for purpose of illustration; however, it will be obvious to one skilled in the art that additional decks may be controlled by adding equivalent circuits. The symbols and notations used for the description of FIGS. 3A and 3B are as follows. The elevator operated switches (proximity switches 31, 33, 35) and the manually operated switches are illustrated in FIGS. 3A and 3B by conventional switch symbols and the specifically identified by reference numerals 101, 103, 105, 107, 109, 111, 113 and 115. The relays (which operate automatically or in response to the above switch operation) have their coils identified by circles and their switches identified by two parallel and spaced apart lines. A normally closed relay switch has an oblique line across the parallel lines and a normally open switch has no such oblique line. It should be noted that the coil and switch, or switches associated with a particular relay are always separated from each other in the drawing symbols.

Assume the elevator has been sent from deck 2 to deck 1. Upon arriving at deck 1 elevator low proximity switch 103 will be closed. Referring to FIG. 1C this is caused by the upper end of bar 31 (elevator mounted) interacting with coil 35 (deck mounted) which sets up a current that closes switch 103 of FIG. 3A. Therefore power will be applied to relay coil 117 which will actuate its associated relay switch 117S. This will apply power to point "A" provided normally closed relay switches 123S and 125S are closed. It should be noted that if there had been an overshoot or if the elevator was approaching from above then elevator high proximity switch 101 would be closed and relay coil 119 would be energized which would close relay switch 119S and also apply power to point "A" assuming switches 123S 125S are closed. When the elevator is at its station then both of switches 101 and 103 would be closed and power will be at point "A" assuming switches 123S and 125S are closed. Relay coil 123 is responsive to current flow when switch 111 is closed which occurs only when the elevator is dispatched down to deck 2 by the deck 1 operator. Relay switch 123S is normally closed and therefore will be closed so long as the elevator is not being dispatched. Relay coil 125 is responsive to current flow when switch 115 is closed which occurs only when the elevator is dispatched up to deck 1 by the deck 2 operator. Relay switch 125S is normally closed and therefore will be closed so long as the elevator is not being dispatched.

Assume now that the elevator is at deck 1, has been loaded, the elevator door is closed and the elevator is not being dispatched. In this situation power will be available at point "A" and the "car here" light 121 is "on", the door lock relay coil 127 is activated and power is available to the dispatch push button switches 109 and 111. When the operator wants to dispatch the elevator to deck 2 he depresses the ganged switches 109 and 111. This activates deck 2 relay coil 129 and dispatch down relay coil 123. Safety relay switches 131S are normally closed and are opened only when an unsafe condition is detected by the motor controller, not shown. Assuming a safe condition and safety relay switches 131S are closed then power appears at point B. Time delay relay 133, dispatch up relay switch (deck 2) 135S and dispatch down relay switch (deck 2) 137S are normally closed switches and therefore power will appear at point "C". Since deck 2 relay coil 129 was activated, by the deck 1 dispatch switch 109, then deck 2 relay switch 129S will be activated which will activate second deck dispatch relay coil 139 where point "D" is the return. This will close relay switch 139S and power will appear at point "E". In addition, since dispatch down relay coil 123 was activated by switch 111 at deck 1 then dispatch down relay switch 123S will be closed which will activate dispatch down relay switch 123S (137S). It should be noted that gang switch 109 and 111 is spring biased and when originally depressed by the operator dispatch down relay coil 123 will open switch 123S but after the operation he removes his finger from the switch then relay coil 123 becomes inactive and relay switch 123S would close. However, relay switch 123S is retained open by relay coil 137. Therefore, the following occurs. Power is removed from point A, "car here" light 121 goes off, door lock relay coil 127 becomes deactivated and power is removed from switches 109 and 111 as well as relay coils 123 and 129. Since relay coil 137 is activated then normally closed relay switch 137S will open and power will be removed from point "C". In addition, relay switch 137S2 will become closed and power will appear at point "E". This will activate high speed relay coil 61 and down relay coil 53 (See FIG. 2A).

As the elevator moves down elevator high (deck 2) proximity switch 105 and elevator low (deck 2) proximity switch 107 will become closed. Therefore elevator high relay coil 143 and elevator low relay coil 145 will become activated. Referring to FIG. 3B when coil 143 activates then relay switch 143S will close and activate relay coil 147. When relay coil 147 is activated then relay switch 147S is closed and current passes through relay switch 147S, 153S and through low speed relay coil 57. Relay switch 147S2 is also opened which interrupts power to high speed relay coil 61. Therefore, the elevator is moving at low speed in the down direction as desired.

When switch 107 closes then relay coil 145 is energized and relay switch 145S is closed which energizes up/slow relay coil 153. Since coils 153 and 147 are activated 153S will open and low speed relay 57 will be inactivated. Also relay switches 147S and 153S2 will open. The elevator will therefore stop. When the elevator stops then relay switches 153S and 147S2 become closed and power is applied to the time delay relay coil 155. After a period of time (1–2 seconds) the time delay relay switch 155S is opened and no power is applied to relay coil 139 and to relay coil 137. Therefore, the dispatch is cancelled and power is applied to point "G" since relay switches 143S and 145S have been closed by relay coils 143 and 145 being energized. Therefore, the "car here" light 157 is turned on. This is based on the assumption that the elevator does not overshoot deck 2.

Assuming the elevator overshoots deck 2 then switch 105 opens and relay coil 143 is inactivated. Therefore switch 143S is open and relay coil 147 is inactivated. Switch 153S is closed, switch 147S3 is closed (147 being deenergized) and up relay coil 49 is activated. Therefore, the elevator will move up. Also, relay switch 153S3 is closed, 147S4 is closed and power is applied to low speed relay coil 57. Therefore, the elevator will move up at a low speed until switch 105 recloses and the elevator stops.

Figure 4:
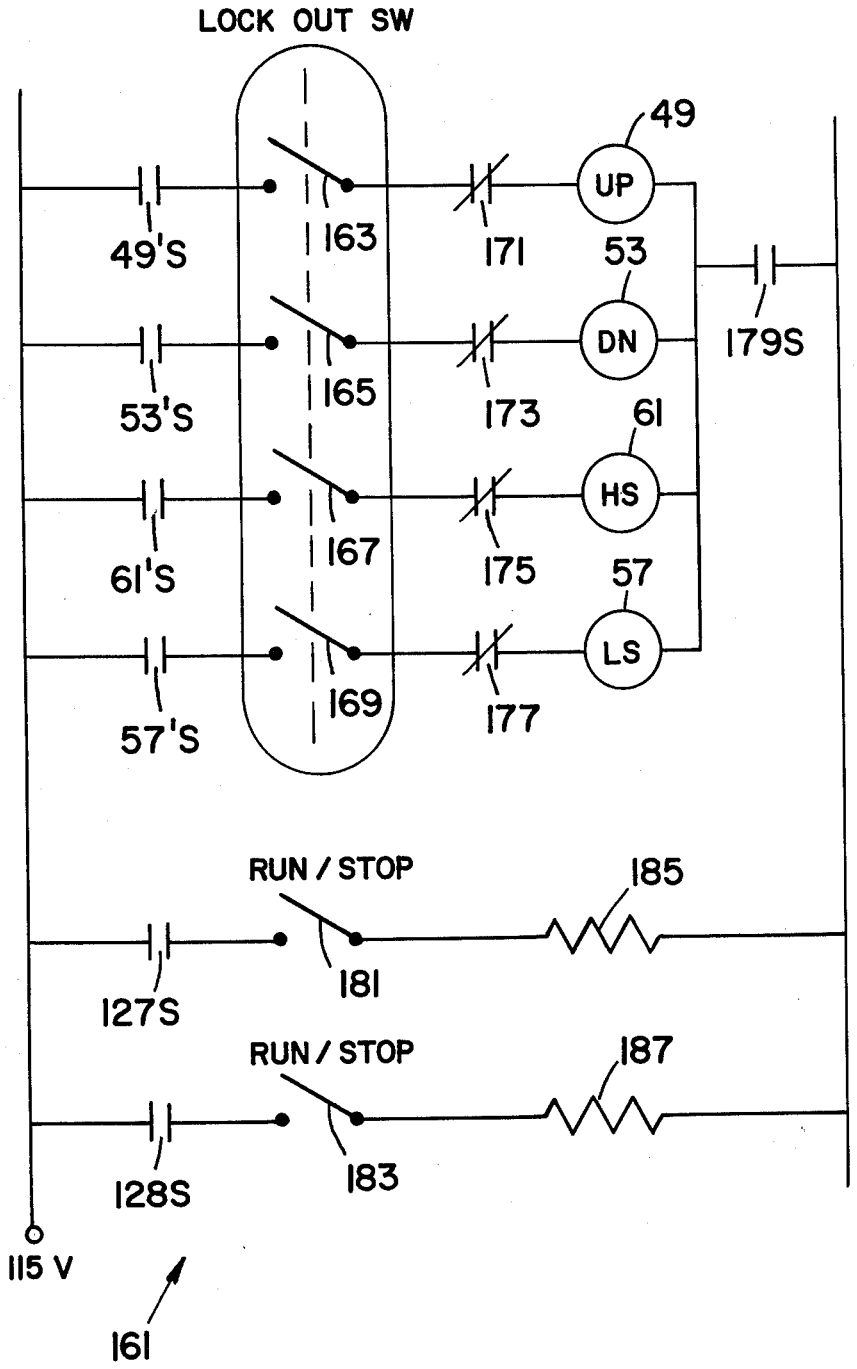
FIG. 4 shows the details of the power/control interface logic of the control system of the present invention.

In FIG. 4 is shown the motor power distribution control circuit 161 of the present invention. This circuit includes relay switches 49'S, 53'S, 61'S and 57'S that are selectively energized by the relay coils 49', 53', 61' and 57' as previously described in the FIG. 3 description. These switches are connected through lock out switches 163, 165, 167 and 169, through relay switches 171, 173, 175 and 177 and through relay coils 49, 53, 61 and 57 shown in FIGS. 2 and 4. The lock out switches are used to lock out the automatic operation if desired. Relay switch 179S is activated the safety relay switches of FIG. 3A. The motor control also includes relay switches 127S, and 128S, stop/run switches 181 and 183 and relay coils 185 and 187. Relay coil 185 will unlock the elevator door at deck 1 when switches 127S and 181 are closed and relay coil 187 will unlock the elevator door at deck 2 when switches 128S and 183 are closed.

What is claimed is:

1. An elevator control system comprising:

(a) first means for sensing the elevator position at a first location;

(b) second means for sensing the elevator position at a second location;

(c) power means for moving said elevator up or down or at high or low speed;

(d) said first means comprises first and second proximity coils;

(e) said second means comprises third and fourth proximity coils;

(f) said first proximity coil position denoting the elevator being above said first location and said second proximity coil position denoting the elevator being below said first location;

(g) said third proximity coil position denoting the elevator being above said second location and said fourth proximity coil position denoting the elevator being below said second location;

(h) said power means including a motor having high and low speed windings, a power source, an up-down phase controller, an up relay switch operably connected to said phase controller for controlling the output of said phase controller to provide an output of one phase, a down relay switch operably connected to said phase controller for controlling the output of said phase controller to provide an output of another phase that is 180 different from said one phase, an up relay coil operably connected to said up relay switch, a down relay coil operably connected to said down relay switch, a low speed relay switch interconnecting the power output of said phase controller and said low speed winding of said motor, a high speed relay switch interconnecting the power output of said phase controller and said high speed winding of said motor, a low speed relay coil operably connected to said low speed relay switch, a high speed relay coil operably connected to said high speed relay switch; and (i) control means responsive to said first and second means and operably connected to said low speed and high speed relay coils for providing a low speed signal for moving said elevator at a low speed in a position adjacent said first location and at a low speed in a position adjacent said second location and a high speed signal for moving said elevator at a high speed between said first and second locations.

2. The system of claim 1 wherein:

(a) said control means including overshoot means operably connected to said up and down relay coils for reversing the direction of said elevator when said elevator first activates said second proximity coil, then simultaneously activates said first and second proximity coils and then activates said first proximity coil.

* * * * *